United States Patent [19]

Strelchenko et al.

[11] 4,004,442

[45] Jan. 25, 1977

[54] MACHINE FOR LONGITUDINAL MULTIPASS KNURLING OF PROFILES

[76] Inventors: Vladimir Sergeevich Strelchenko, prospekt Lenina, 75, kv. 57; Valery Ilich Gomlyakov, ulitsa Molodezhnaya, 62, kv. 27, both of Barnaul, U.S.S.R.

[22] Filed: Feb. 23, 1976

[21] Appl. No.: 660,493

[52] U.S. Cl. ..... 72/214; 72/224

[51] Int. Cl.[2] ..... B21B 17/00

[58] Field of Search ..... 72/194, 224, 214

[56] References Cited

UNITED STATES PATENTS

| | | | |
|---|---|---|---|
| 2,929,282 | 3/1960 | Retterath | 72/224 |
| 2,991,673 | 7/1961 | Van Rooij | 72/214 X |

*Primary Examiner*—Milton S. Mehr

*Attorney, Agent, or Firm*—Lackenbach, Lilling & Siegel

[57] ABSTRACT

The invention relates to mechanical engineering.

The proposed machine comprises parallel stationary crossbars rigidly interconnected by slides and carrying centers for positioning a workpiece. Mounted on the slides, between the stationary crossbars, and adapted for reciprocating motion along the centers' axis is a movable crossbar with a knurling head in whose housing there are provided radial slots, wherein there are installed sliders with knurls, said sliders being movable in said slots by a device comprising self-braking wedges installed in pairs in each radial slot and stops interacting with said wedges, said stops being mounted on the stationary crossbars and being adapted for reciprocating motion.

5 Claims, 4 Drawing Figures

MACHINE FOR LONGITUDINAL MULTIPASS KNURLING OF PROFILES

The present invention relates to metal working and, more particularly, to machines for longitudinal multipass knurling of profiles.

The invention is most advantageous in shaft splining, as well as in shaping teeth of gears, polyhedrons, etc.

Known in the art are machines for multipass knurling of profiles (cf. USSR Inventor's Certificate No 350,553) comprising two parallel stationary crossbars carrying centers for positioning a workpiece and rigidly joined together by slides, whereupon there is mounted between the stationary crossbars and adapted for reciprocating motion along the centers' axis a movable crossbar carrying a knurling head arranged coaxially with the centers. In the housing of said knurling head there are provided radial slots, each receiving a slider with a knurl. Provision is also made for a device for moving said sliders in the radial slots, said device comprising self-braking wedges and stops interacting with said wedges in the extreme positions of the movable crossbar. The self-braking wedges have their same ends facing toward the same stationary crossbar, each wedge being installed in one of the radial slots to interact with the slider. The stops are mounted on both stationary crossbars, each opposite one of the self-braking wedges.

In such machines, each self-braking wedge of the slider moving device is received in the radial slot of the knurling head between the slider and the back wall of said slot. The larger butt ends of all the wedges face the upper stationary crossbar.

The movement of the sliders with the knurls toward the workpiece takes place in the uppermost position of the movable crossbar. Each stop, which is rigidly mounted on the upper crossbar, interacts with the larger butt end of one of the self-braking wedges and moves the latter. In turn, each self-braking wedge interacts with the slider and moves it over a distance corresponding to the feed of the knurl in one knurling pass.

As the movable crossbar moves downward, the knurls interact with the workpiece, and the first knurling pass is effected. This is the working stroke of the knurling head. The return stroke of the knurling head is idle. This sequence of events is repeated until the desired profile is completed.

When the work is finished, the workpiece is removed, and the movable crossbar with the knurling head is brought to the lowermost position.

The stops, which are rigidly mounted on the lower crossbar, interact with the lesser (in terms of area) butt ends of the self-braking wedges and return them to the initial position to start working another workpiece.

During an idle stroke of the knurling head, the knurls come into contact with the workpiece, whereby their wear is accelerated. The use of rigidly mounted stops affects the accuracy of working and the stability of the workpieces' parameters. These factors account for limited potentialities and output of machines under review.

It is an object of the present invention to provide a machine for longitudinal multipass knurling of profiles, which would make it possible to eliminate the idle stroke of the knurling head and to ensure greater precision of movement of the sliders with the knurls, which is bound to increase the working accuracy, improve the size stability and substantially raise the machine's output.

It is another object of the invention to provide a machine for longitudinal multipass knurling of profiles with a greater output, as compared to conventional machines of this kind.

The foregoing and other objects of the present invention are attained by providing a machine for longitudinal multipass knurling of profiles comprising two parallel stationary crossbars carrying centers for positioning a workpiece and rigidly interconnected by slides, whereupon there is mounted between the stationary crossbars and adapted for reciprocating motion along the centers' axis a movable crossbar carrying a knurling head which is coaxial with the centers, the housing of said knurling head being provided with radial slots, each slot receiving a slider with a knurl, said machine further including a device for moving said sliders comprising self-braking wedges and stops, said stops interacting with said wedges at the extreme positions of the movable crossbar, the self-braking wedges having their same butt ends facing toward the same stationary crossbar, each of said wedges being installed in one of the radial slots to interact with the slider, the stops being mounted on both stationary crossbars, each opposite one of the self-braking wedges. According to the invention, in each radial slot there is a second self-braking wedge arranged so that its butt end faces the side opposite the location of the same butt end of the first self-braking wedge, there being mounted a respective stop on the stationary crossbars opposite each of said second self-braking wedges, all the wedges that interact with the lesser butt ends of the self-braking wedges being adapted for adjustable reciprocating motion along the centers' axis and being depressed in the initial position with respect to the stops interacting with the larger butt ends of the self-braking wedges.

The foregoing design makes it possible to knurl a workpiece both during the forward and the back strokes of the knurling head. Thus, the proposed design excludes the idle stroke of the knurling head and thereby ensures size accuracy and stability, raises the output of the machine and reduces tool wear.

It is expedient that the reciprocating adjustment motion of the stops along the centers' axis should be effected by means of two groups of hydraulic cylinders, each of said groups being mounted on one of the stationary crossbars. These stops are to be supported by a flat ring rigidly secured to the rods of each group of cylinders coaxially with the centers.

The adaptation of the stops for reciprocating motion ensures the bringing of the wedges into the initial position by a required calculated value without additionally moving the crossbar with the knurling head, which makes it possible to shorten the slides and, consequently, the height of the machine, whereby the rigidity of the machine is improved.

The use of the hydraulic cylinders in the proposed machine makes it possible to employ the common hydraulic drive of the machine without resorting to additional drive means.

It is also expedient that the stops which interact with the larger butt ends of the self-braking wedges should be constructed as pins that are spring-loaded in the axial direction toward the movable crossbar, one end of each pin being mounted on one of two removable flat rings, each said ring being rigidly mounted on one of the stationary crossbars coaxially with the centers.

The spring-loaded stops compensate for any inaccuracies of the last working stroke of the movable cross bar; in emergency situations, these stops function as shock absorbers.

The removable rings make it possible to quickly replace the stops in re-adjusting the machine for a workpiece of a different size. This considerably expands the machine's potentialities.

It is practicable that each stop, which interacts with the larger butt end of each self-braking wedge, should have a finger secured at its free end and be adapted for axial adjustment motion to adjust the height of said stop.

This makes it possible to adjust the motion of each self-braking wedge in the course of adjusting the machine.

Finally, it is expedient that each additional self-braking wedge, interacting with the finger received in the free end of the rod of the spring-loaded stop, should be provided, on the side of the greater butt end, with a stroke limiter, and that the wedge depth should be adjustable.

The provision of the wedges with a stroke limiter ensures accurate adjustment of each wedge for the last finishing pass, which considerably improves the size accuracy of workpieces.

Other objects and advantages of the present invention will become more apparent from the following detailed description of a preferred embodiment thereof taken in conjunction with the accompanying drawings, wherein.

Figure 1:
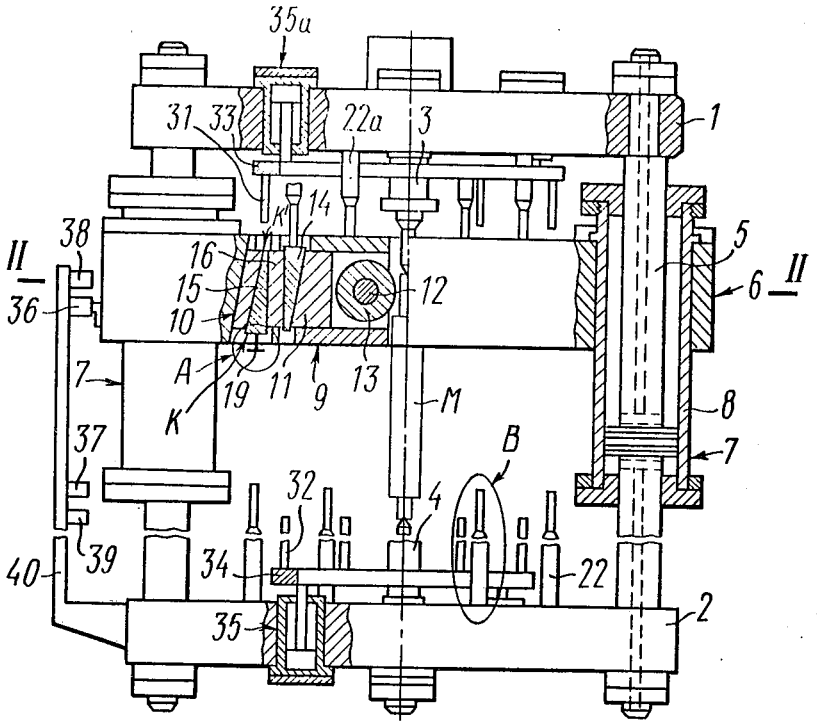
FIG. 1 is a general schematic view partially broken away of a machine for longitudinal multipass knurling of profiles, in accordance with the invention.

Referring now to the attached drawings, the proposed machine for longitudinal multipass knurling of profiles comprises two parallel stationary crossbars 1 and 2 (FIG. 1), one of which is mounted on a box-type base (not shown). On the stationary crossbar 1 there is mounted a movable center 3. On the stationary crossbar 2 there is mounted a second center 4 for positioning a workpiece. Said center 4 is arranged coaxially with said center 3.

Said stationary crossbars 1 and 2 are rigidly connected one to the other by cylindrical slides 5. Said slides 5 are arranged symmetrically with respect to the axis of the centers 3 and 4. Mounted on said slides 5, between the stationary crossbars 1 and 2, is a movable crossbar 6. Said movable crossbar 6 is adapted for reciprocating motion along the axis of the centers 3 and 4 on the cylindrical slides 5, whereupon it is mounted by means of hydraulic cylinders 7. A housing 8 for each hydraulic cylinder 7 is rigidly secured to the movable crossbar 6. The cylindrical slide 5 is the rod of said hydraulic cylinder 7. Each cylindrical slide 5 is provided with drilled holes for the supply of working fluid into the cylinder 7.

Installed in the movable crossbar 6, coaxially with the centers 3 and 4, is a detachable knurling head 9 whose housing 10 is arranged in the movable crossbar 6 and secured by tacks (not shown). In the housing 10 of the knurling head 9 there are radial slots "C" which receive sliders 11 whereupon on axles 12 there are freely mounted knurls 13. The sliders 11 are moved in the radial slots "C" by a device which comprises, according to the invention, self-braking wedges 14 and 15 installed in pairs in said slots "C".

Figure 2:
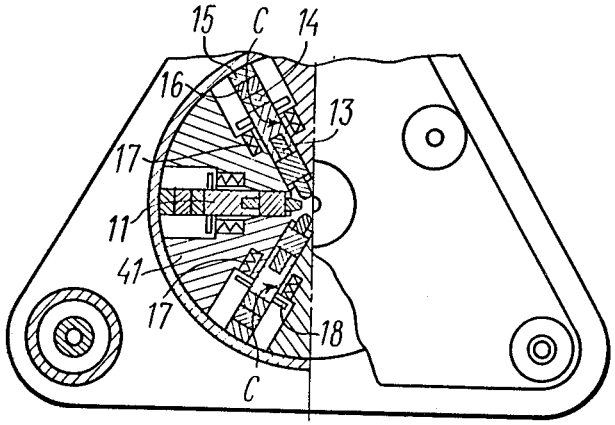
FIG. 2 is a sectional view taken along the line II—II of FIG. 1.

Each pair of wedges 14 and 15 is arranged between the back wall of the slot "C" and the slider 11 and has a gasket 16 between said wedges 14 and 15. The wedges 14 and 15 are arranged so that their same ends "K" and "K'" (FIG. 1) face in different directions. Each slider 11 (FIG. 2) is pressed against the wedges 14 and 15 by at least two compression springs 17 arranged in cylindrical seats provided in the housing 10 of the knurling head 9 and extending in the radial direction in parallel with the slot "C" said springs 17 being on each side of said slider 11. One end of each said spring 17 abuts against the bottom of the seat, the other end of each said spring 17 abuts against a pin 18 mounted on the slider 11.

Figure 3:
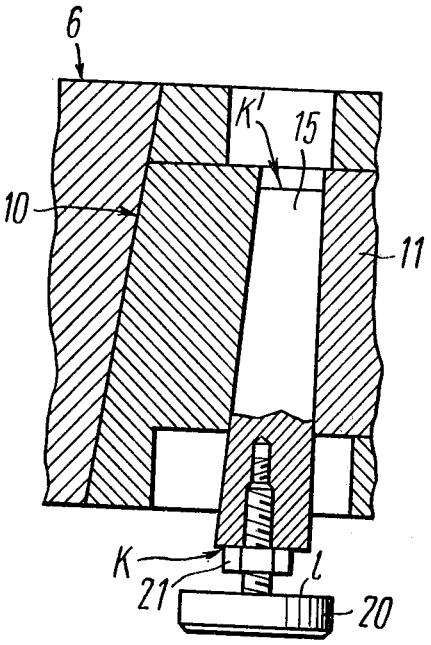
FIG. 3 is a magnified view of the area A of FIG. 1.

Each wedge 15 is provided with an arrester 19 which is constructed as a screw 20 (FIG. 3) screwed into the larger butt end "K" of each wedge 15 and locked by a nut 21.

Figure 4:
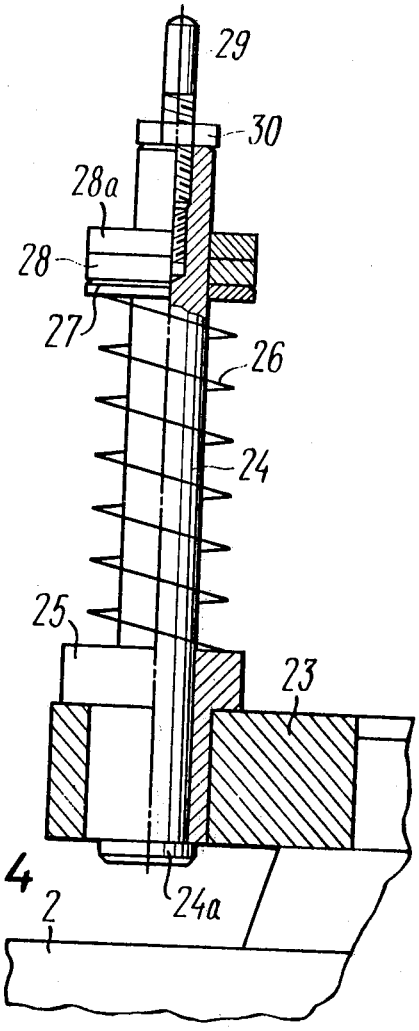
FIG. 4 is a magnified view of the area B of FIG. 1.

In addition the device for moving the sliders 11 (FIG. 4) with the knurls 13 is provided, according to the invention, with stops 22 mounted on each of two removable flat rings 23. Said rings 23 are rigidly secured to the stationary crossbars 1 and 2 coaxially with the centers 3 and 4. Each stop 22 is constructed, according to the invention, as a pin 24 which is spring-loaded in the axial direction. One end of said pin 24, which is provided with a limiting bead 24*a*, is installed in a bush 25 which is rigidly secured in the removable ring 23.

Fitted over the pin 24 is a compression spring 26. One end of said spring 26 abuts against the bead of the bush 25 and the other end abuts against a washer 27 fitted over the free end of the pin 24 and interacts with a nut 28 screwed onto the free end of the pin 24 and locked by a nut 28*a*.

Arranged in the butt portion of the free end of the pin 24 and adapted for axial adjustment movement is a finger 29 whereupon there is a nut 30 which adjusts the pin 24 in height with respect to the end of the pin 24.

In order to bring the self-braking wedges 14 and 15 (FIG. 1) back to the initial position, the device for moving the sliders 11 is provided with stops 31 and 32 rigidly mounted on each of two removable rings, 33 and 34, respectively. Said rings 33 and 34 are mounted on the respective stationary crossbars 1 and 2 and adapted for reciprocating motion along the axis of the centers 3 and 4. Said rings 33 and 34 are set in motion by two groups of hydraulic cylinders 35 and 35*a*. Each of said groups 35 and 35*a* is mounted on one of the stationary crossbars 1 and 2. Rigidly secured to the rods of each group of the hydraulic cylinders 35 and 35*a* is one of said flat rings 33 and 34, said rings being arranged coaxially with the centers 3 and 4.

Operation of the proposed machine for longitudinal multipass knurling of profiles is controlled both under automatic and semi-automatic conditions by instructions from limit switches 36, 37, 38 and 39 mounted on a support 40 which is secured to the stationary crossbar 2.

The proposed machine for longitudinal multipass knurling of profiles operates as follows.

The main hydraulic drive is put into action and powers the hydraulic drives of the machine.

A workpiece "M" is installed between the centers 3 and 4. The movable center 3 is brought into play and presses the workpiece "M" against the stationary center 4. The machine is adjusted for automatic knurling conditions. At this moment, the movable crossbar 6 is in its uppermost position opposite the limiting switch 36. With the movable crossbar 6 being in the above-mentioned position, the knurls 13 are found in their initial position.

A signal is initiated to move the movable crossbar 6 downward. The knurls 13 come into contact with the workpiece "M" and start deforming the latter. The knurling head 9 makes the first knurling pass. The movable crossbar 6 goes down until it is found opposite the limiting switch 37. At this moment, the larger butt ends "K" of the self-braking wedges 15 come into contact with the stops 22 mounted on the lower stationary crossbar 2. As a result, the wedges 15 go upward and move the sliders 11 with the knurls 13 in the radial slots "C" in the direction of the workpiece "M" by a feed value required for the second knurling pass. Each finger 29 of each stop 22 abuts against the outer butt end of the knurling head 9 of the respective screw 20 of the stop 19 on each stroke of the self-braking wedge 15. The limiting switch 37 initiates an instruction for a reverse stroke, and the movable crossbar 6 goes upward until it reaches the limiting switch 38. The knurling head 9 then makes the second knurling pass. As this takes place, the limiting switch 36 is de-energized. The larger butt ends "K" of the self-braking wedges 14 come into contact with the stops **22*a* mounted on the upper stationary crossbar 1. The wedges 14 go down and move the sliders 11 with the knurls 13 in the radial slots by a feed value required for the next knurling pass. An instruction from the limiting switch 38 starts the reverse stroke, and the movable crossbar 6 goes down to reach the limiting switch 39. The knurling head 9 makes another knurling pass, and the crossbar 6 assumes its lowermost position. As this takes place, the limiting switch 37** is de-energized.

The stops 22 which are mounted on the lower stationary crossbar 2 interact with the self-braking wedges 15. The wedge 15 assumes its extreme position, when the inner butt end 1 of the screw head 20 abuts against the lower butt end of the housing 10 of the knurling head 9. Inaccurate stopping of the movable crossbar 6 in its lowermost position is compensated for by the spring 26. In the previous passes of the movable crossbar 6, the wedges 14 and 15 are moved by the stops 22 and **22*a* without compressing the springs 26, because the compression force of the springs 26 is greater than the force required to move the self-braking wedges 14 and 15**.

An instruction from the limiting switch 39 initiates a reverse stroke, and the movable crossbar 6 goes up to reach the limiting switch 36. The knurling head then makes the final knurling pass. Simultaneously with an instruction for a reverse stroke, the limiting switch 39 sends an instruction to the group of hydraulic cylinders **35*a* mounted on the upper stationary crossbar 1, whereby the ring 33 with the rigid stops 31 moves in the direction opposite to the upward movement of the movable crossbar 6 to assume a position when the ends of the stops 31 are below the ends of the stops 22*a***.

The stops 31 interact with the lesser butt ends K′ of the self-braking wedges 15 and move the latter into the initial position. Under the action of the springs 17, the sliders 11 also assume their initial position.

The limiting switch 36 sends, with a certain time lag, an instruction to the group of hydraulic cylinders **35*a* to bring the ring 33** back to the initial position. At this point the automatic cycle of the knurling process is ended.

An instruction is sent to the movable center 3, and the finished workpiece "M" is removed from the centers 3 and 4. Then, an instruction is sent to move the movable crossbar 6 so that it can reach the limiting switch 37. Simultaneously, an instruction is sent to the group of hydraulic cylinders 35 mounted on the lower stationary crossbar 2, and said hydraulic cylinders move the ring 34 with the rigid stops 32 in the direction opposite to that of the downward-going movable crossbar 6. The stops 32 assume a position when their ends are above the ends of the stops 22.

The stops 32 interact with the lesser butt ends K′ of the self-braking wedges 14 and move said wedges 14 to the initial position. As this takes place, the sliders 11 are brought to the initial position by the springs 17. After the self-braking wedges 14 have assumed their initial position, the limiting switch 37 sends, with a certain time lag, an instruction to group of the hydraulic cylinders 35 to bring the ring 34 back to the initial position.

In addition, in this position of the movable crossbar 6, the stops 22 bring the self-braking wedges 15 to the initial position for the first knurling pass on the next workpiece. The limiting switch 37 sends an instruction to raise the movable crossbar 6 to the level of the limiting switch 36, after which the stops **22*a* bring the self-braking wedges 14** to the initial position for the first knurling pass on the next workpiece. Then the entire knurling cycle is repeated.

The number of limiting switches mounted on the support 40 is equal to the number of strokes of the movable crossbar 6.

The number of knurling passes is determined by that of limiting switches mounted on the support 40.

What is claimed is:

1. A machine for longitudinal multipass knurling of profiles, comprising: parallel stationary crossbars; slides rigidly coupling said stationary crossbars one to the other; centers for positioning a workpiece, which are mounted one opposite the other of said stationary crossbars; a movable crossbar mounted between said stationary crossbars on said slides and adapted for reciprocating motion along the axis of said centers; a knurling head mounted on said movable crossbar coaxially with said centers and having a housing wherein there are slots arranged radially with respect to the axis of said centers; sliders received in said radial slots; knurls installed in said sliders and adapted for rotation; a device for moving said sliders with said knurls in said radial slots, comprising self-braking wedges installed in pairs in each radial slot to interact with said sliders, the same butt ends of said self-braking wedges facing in opposite directions, and stops interacting with said self-braking wedges, said stops being mounted on each of said stationary crossbars, each stop being opposite one of said self-braking wedges, the stops which interact with the lesser butt ends of said self-braking wedges being adapted for reciprocating adjustment motion along the axis of said centers and being depressed in the initial position relative to the stops interacting with the larger butt ends of said self-braking wedges.

2. A machine as claimed in claim 1, wherein reciprocating adjustment motion of the stops along the centers' axis is effected by two groups of hydraulic cylinders, each group being mounted on one of the stationary crossbars, there being secured to the rods of each group of hydraulic cylinders a flat ring carrying said stops, said flat ring being arranged coaxially with the centers.

3. A machine as claimed in claim 1, wherein the stops which interact with the larger butt ends of the self-braking wedges are constructed as pins that are spring-loaded axially and in the direction of the movable crossbar, one end of each of said pins being mounted on one of two removable flat rings, each of said rings being rigidly mounted on one of the stationary cross-bars coaxially with the centers.

4. A machine as claimed in claim 3, wherein each stop which interacts with the larger butt end of one of the self-braking wedges has a finger mounted in its free butt end coaxially therewith and adapted for adjustment axial motion in order to adjust the height of said stop.

5. A machine as claimed in claim 4, wherein each wedge, interacting with the respective finger secured in the butt of the free end of the stop, is provided with a stroke limiter constructed as a screw screwed into the larger butt of the wedge and locked by a nut, said screw being movable in order to adjust the wedge depth.

* * * * *